US009718273B2

(12) United States Patent
Matsuduki et al.

(10) Patent No.: US 9,718,273 B2
(45) Date of Patent: Aug. 1, 2017

(54) CLEANING APPARATUS AND LIQUID DROPLET EJECTION APPARATUS

(71) Applicant: FUJI XEROX CO., LTD., Tokyo (JP)

(72) Inventors: Masato Matsuduki, Kanagawa (JP); Yasunori Toda, Kanagawa (JP); Osamu Shimizu, Kanagawa (JP); Takashi Saeki, Kanagawa (JP); Yuichi Inoue, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 14/953,477

(22) Filed: Nov. 30, 2015

(65) Prior Publication Data

US 2016/0318306 A1 Nov. 3, 2016

(30) Foreign Application Priority Data

Apr. 30, 2015 (JP) ..... 2015-093044

(51) Int. Cl.
*B41J 2/165* (2006.01)
*B08B 3/12* (2006.01)

(52) U.S. Cl.
CPC ..... *B41J 2/16517* (2013.01); *B08B 3/12* (2013.01); *B41J 2/16552* (2013.01); *B41J 2002/16567* (2013.01)

(58) Field of Classification Search
None
See application file for complete search history.

(56) References Cited

U.S. PATENT DOCUMENTS

2014/0097267 A1* 4/2014 Shitara ..... B05B 15/025 239/106

FOREIGN PATENT DOCUMENTS

| | | |
|---|---|---|
| JP | 2005-28758 | 2/2005 |
| JP | 2009-149041 | 7/2009 |
| JP | 2013-31962 | 2/2013 |

OTHER PUBLICATIONS

Abstract and machine translation of JP 2005-28758.
Abstract and machine translation of JP 2009-149041.
Abstract and machine translation of JP 2013-31962.

* cited by examiner

*Primary Examiner* — Justin Seo
(74) *Attorney, Agent, or Firm* — Fildes & Outland, P.C.

(57) ABSTRACT

A cleaning apparatus includes a contact unit that includes a container in which an opening is formed, the container accommodating cleaning liquid that cleans a forming surface of an ejection unit, the forming surface on which an ejection opening is formed, the ejection opening from which a liquid droplet is ejected; and an ultrasonic vibrator that is provided at the container and vibrates the cleaning liquid accommodated in the container, wherein the contact unit brings the cleaning liquid into contact with the forming surface in a state where the opening of the container faces the forming surface.

7 Claims, 10 Drawing Sheets

CLEANING APPARATUS AND LIQUID DROPLET EJECTION APPARATUS

CROSS-REFERENCE TO RELATED APPLICATIONS

This application is based on and claims priority under USC 119 from Japanese Patent Application No. 2015-093044, filed on Apr. 30, 2015.

BACKGROUND

Technical Field

The present invention relates to a cleaning apparatus and a liquid droplet ejection apparatus.

SUMMARY

An aspect of the present invention provides a cleaning apparatus comprising: a contact unit that includes a container in which an opening is formed, the container accommodating cleaning liquid that cleans a forming surface of an ejection unit, the forming surface on which an ejection opening is formed, the ejection opening from which a liquid droplet is ejected; and an ultrasonic vibrator that is provided at the container and vibrates the cleaning liquid accommodated in the container; wherein the contact unit brings the cleaning liquid into contact with the forming surface in a state where the opening of the container faces the forming surface.

BRIEF DESCRIPTION OF THE DRAWINGS

Exemplary embodiment(s) of the present invention will be described in detail based on the following figures, wherein.

DETAILED DESCRIPTION

Figure 1:
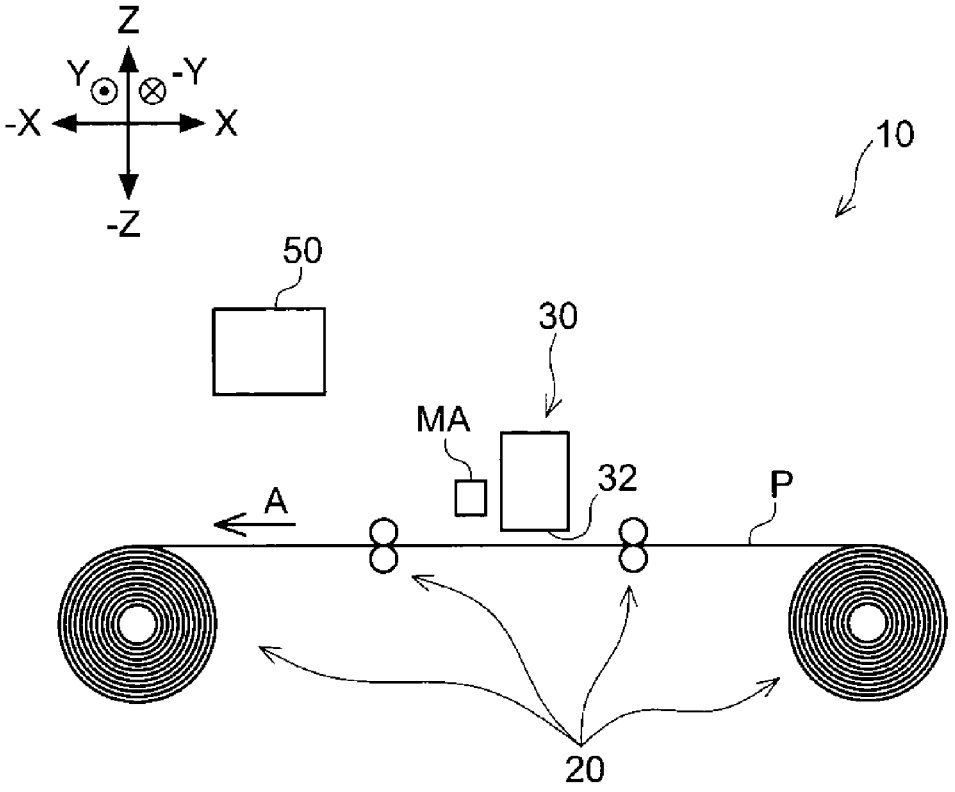
FIG. 1 is a schematic view (front side view) of a liquid droplet ejection apparatus according to a first embodiment.

Exemplary embodiments for executing the present invention will be described below in the first to fourth embodiments. In the description below, a direction that is indicated in the drawings by an arrow X and an arrow −X is set as an apparatus width direction, and a direction that is indicated in the drawings by an arrow Y and an arrow −Y is set as an apparatus depth direction. In addition, a direction that is orthogonal to each of the apparatus depth direction and the apparatus width direction (an arrow Z and an arrow −Z) is set as an apparatus height direction.

First Embodiment

A first embodiment will be described. First, an overall configuration and an image formation operation of a liquid droplet ejection apparatus 10 of the present embodiment will be described. Next, a configuration and a cleaning operation of a cleaning apparatus 40 that is a main section of the liquid droplet ejection apparatus 10 of the present embodiment will be described. Next, the operations of the present embodiment will be described.

<Overall Configuration of the Liquid Droplet Ejection Apparatus>

The liquid droplet ejection apparatus 10 of the first embodiment is an ink jet-type apparatus that forms an image (image) using ink on a medium P that is transported. Here, the ink that is used in the embodiment is, for example, a water based ink (ink that includes water in a solvent).

Figure 2:
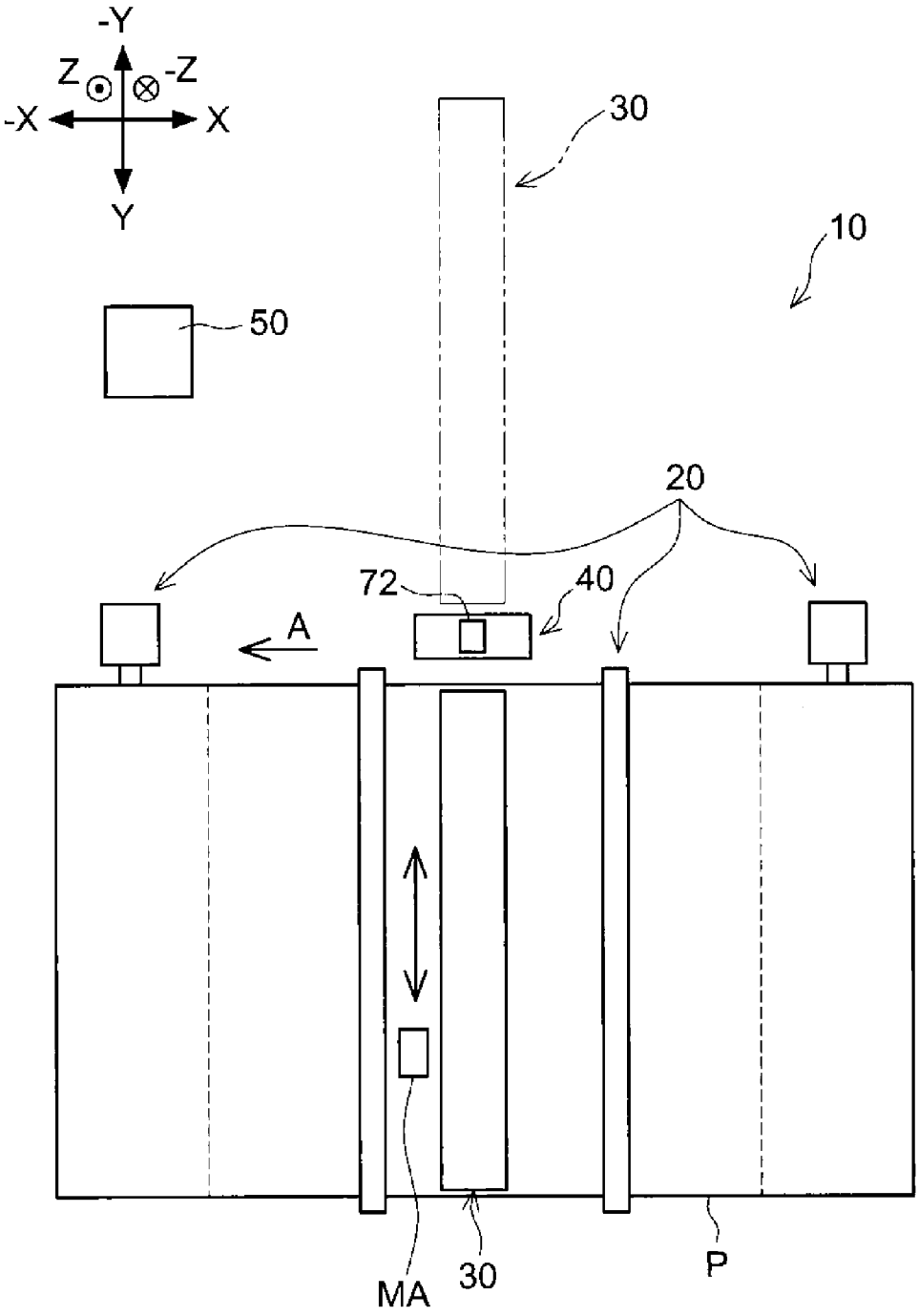
FIG. 2 is a schematic view (upper side view) of the liquid droplet ejection apparatus according to the first embodiment.

As shown in FIGS. 1 and 2, the liquid droplet ejection apparatus 10 is configured to include a transport mechanism 20, a head 30, the cleaning apparatus 40, a moving apparatus MA, and a control unit 50.

[Transport Mechanism]

The transport mechanism 20 has a function of delivering the medium P onto a transport path, transporting the medium P along the transport path, and winding the medium P on which an image is formed. Here, in FIGS. 1 and 2, the arrow A indicates the transport direction of the medium P.

[Head]

The head 30 has a function of ejecting liquid droplets (particulate ink) on the medium P that is transported by the transport mechanism 20. Here, the head 30 is an example of an ejection unit.

Figure 3:
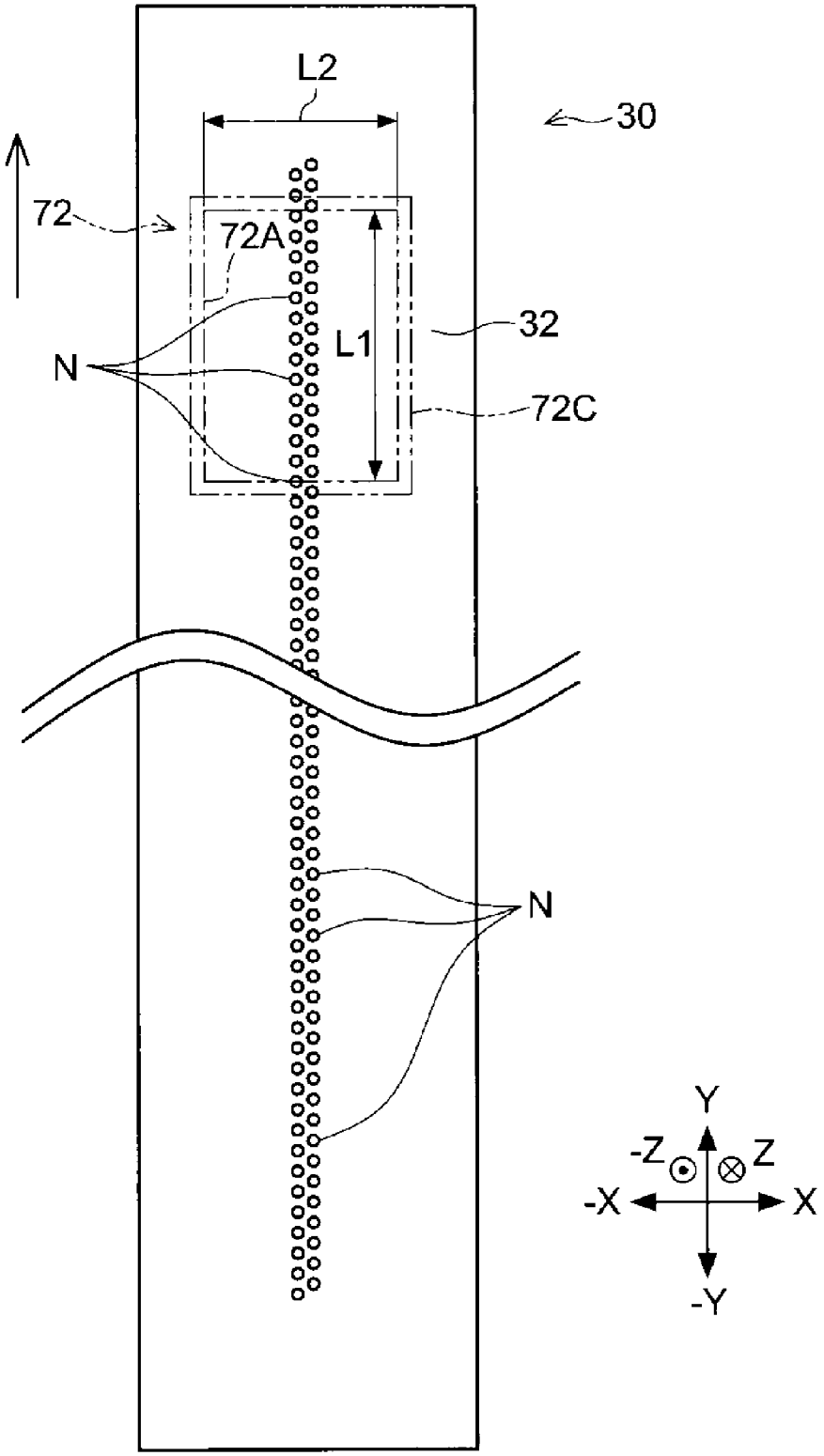
FIG. 3 is a schematic view of a nozzle forming surface of a head that configures the liquid droplet ejection apparatus according to the first embodiment.

As shown in FIGS. 2 and 3, the head 30 has an elongated shape. As shown in FIG. 2, the longitudinal direction of the head 30 is disposed in a state of being along the apparatus depth direction. In addition, as shown in FIG. 3, a nozzle forming surface 32 on which plural nozzles N are disposed in a zig-zag shape along the longitudinal direction is formed on the underside of the head 30 in the apparatus height direction. Then, the head 30 ejects liquid droplets from the plural nozzles N. In addition, a water-repellent coat is formed on the nozzle forming surface 32 of the embodiment. Here, the nozzle N is an example of an ejection opening. In addition, the nozzle forming surface 32 is an example of a forming surface on which the ejection opening is formed.

The head 30 is moved by the moving apparatus MA that will be described later (see FIGS. 1 and 2) in a state of being positioned in the apparatus height direction, and moves within a predetermined range of the apparatus depth direction (the longitudinal direction of the head 30). In FIG. 2 the predetermined range ranges from a position of the head 30 that is illustrated by a solid line (hereinafter referred to as a "first position") to a position of the head 30 that is illustrated by a chain double-dashed line (hereinafter referred to as a "second position"). The head 30 is disposed at the first position during the image formation operation. Here, the second position is a position further on the depth side in the apparatus depth direction than the first position (and the cleaning apparatus 40 that will be described later).

[Cleaning Apparatus]

The cleaning apparatus 40 has a function of cleaning the nozzle forming surface 32 of the head 30 during the cleaning operation. Here, the nozzle forming surface 32 being cleaned means that foreign material on the nozzle forming surface 32 is removed. The foreign material refers to the material that is generated in association with use of the liquid droplet ejection apparatus 10, such as solids of ink, paper powder, dust, and other adhesive material.

The cleaning apparatus 40 is disposed further on the depth side in the apparatus depth direction (see FIG. 2) and further on the lower side in the apparatus height direction (see FIG. 1) than the head 30. Then, the cleaning apparatus 40 cleans the nozzle forming surface 32 facing (the nozzle forming surface 32 of) the head 30 that is moved from the first position to the second position by the moving apparatus MA. In other words, the moving apparatus MA moves the cleaning apparatus 40 (a cleaning tank 72 that will be described later) relative to the head 30 in the longitudinal direction of the head 30 during the cleaning operation. Here, the moving apparatus MA is an example of movement unit.

A summary of the cleaning apparatus 40 is described above, but details of the cleaning apparatus 40 will be described below.

[Control Unit]

The control unit 50 has a function of controlling each member that configures the liquid droplet ejection apparatus 10 other than the control unit 50.

The control unit 50 of the embodiment stores the total amount of liquid droplets that are ejected by the head 30 in a memory device (not shown). Then, for example, the control unit 50 causes the cleaning apparatus 40 to perform the cleaning operation when the total amount reaches a predetermined amount. In detail, when the total amount reaches the predetermined amount during a period in which the liquid droplet ejection apparatus 10 performs an image formation operation, after the end of the image formation operation, the control unit 50 causes the cleaning apparatus 40 to perform the cleaning operation. Here, when the cleaning operation ends, the control unit 50 resets the total amount which is stored in the memory device, and then stores the total amount of the liquid droplets that are ejected by the head 30 again in the memory device.

Other functions of the control unit 50 will be described in the image formation operation of the liquid droplet ejection apparatus 10 and the cleaning operation of the cleaning apparatus 40 that will be described later.

The overall configuration of the liquid droplet ejection apparatus 10 of the present embodiment is described above.

<Image Formation Operation of Liquid Droplet Ejection Apparatus>

Next, the image formation operation of the liquid droplet ejection apparatus 10 of the present embodiment will be described with reference to FIGS. 1 and 2.

The control unit 50 that receives job data, which includes image data, from an external apparatus (not shown) operates the transport mechanism 20 and the head 30. Then, an image is formed on the medium P when the head 30 ejects liquid droplets according to the image data on the medium P that is transported in the transport direction by the transport mechanism 20. The medium P on which the image is formed is transported in the transport direction by the transport mechanism 20 so as to be wound in a roll shape, and the image formation operation ends.

The image formation operation of the liquid droplet ejection apparatus 10 of the present embodiment is described above.

<Configuration of Main Section (Cleaning Apparatus)>

Figure 4:
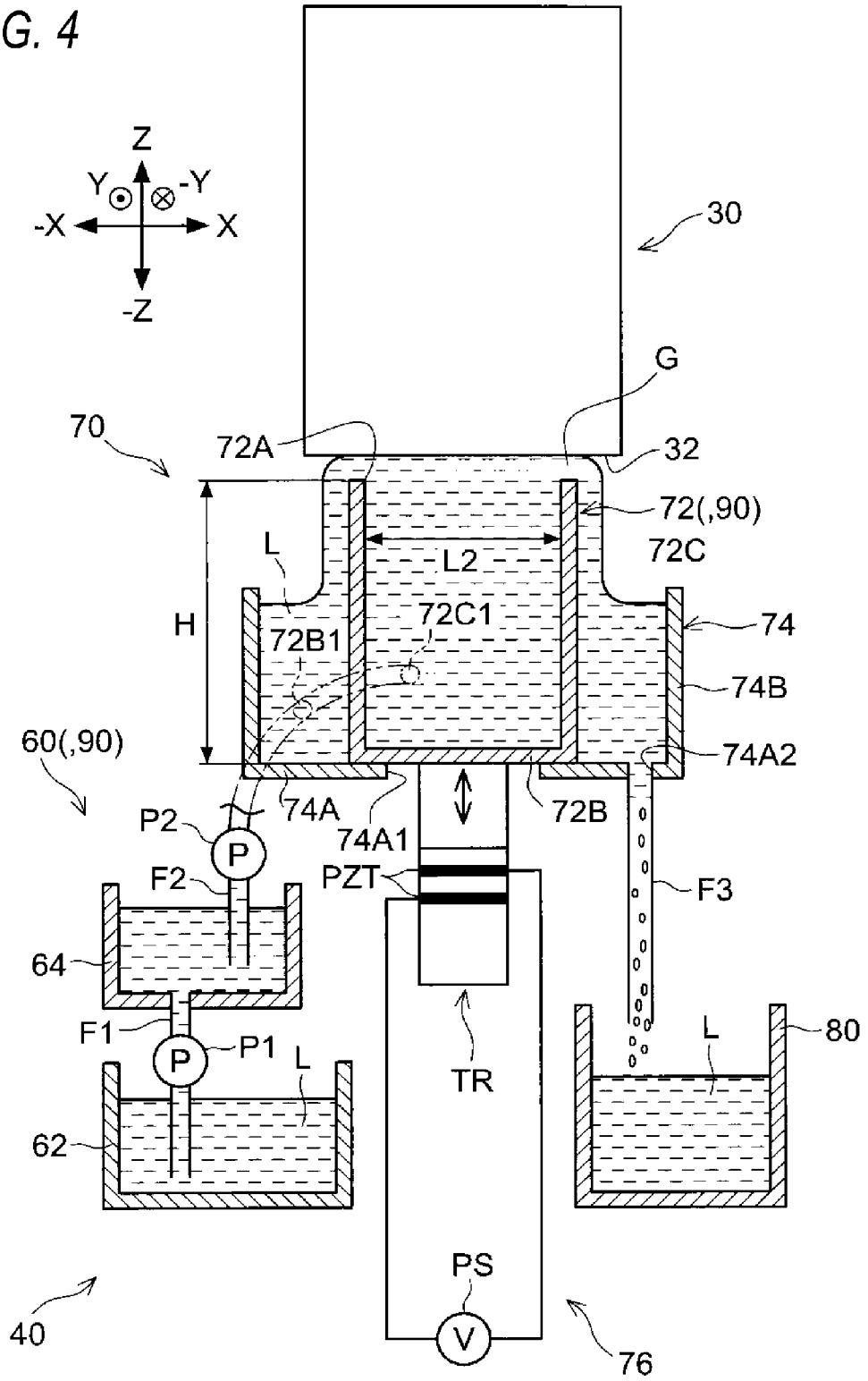
FIG. 4 is a schematic view of a cleaning apparatus and the head that configures the liquid droplet ejection apparatus according to the first embodiment.

Next, the cleaning apparatus 40 will be described with reference to the drawings. As shown in FIG. 4, the cleaning apparatus 40 is configured to include a cleaning liquid supply unit 60, a cleaning unit 70, a waste liquid accommodation unit 80, and the moving apparatus MA. Here, the cleaning liquid supply unit 60 is an example of supply unit.

[Cleaning Liquid Supply Unit]

The cleaning liquid supply unit 60 has a function of supplying a cleaning liquid L for cleaning the nozzle forming surface 32 to the cleaning unit 70 (cleaning tank 72 of the cleaning unit 70 that will be described later). As shown in FIG. 4, the cleaning liquid supply unit 60 is configured to include a main tank 62, a sub tank 64, a first pump P1, a second pump P2, a first flow path F1, and a second flow path F2. The first pump P1 and the second pump P2 are respectively provided in the first flow path F1 and the second flow path F2. Here, for example, the cleaning liquid L of the present embodiment is water. In addition, the sound speed in the cleaning liquid L of the present embodiment is set, for example, to approximately 1483 m/s.

The main tank 62 is the container which accommodates the cleaning liquid L. The sub tank 64 is the container in which the cleaning liquid L that is transported from the main tank 62 and is supplied to the cleaning unit 70 is temporarily accommodated, and is disposed above the main tank 62. Here, the main tank 62 and the sub tank 64 are connected by the first flow path F1, and the sub tank 64 and (the cleaning tank 72 of) the cleaning unit 70, that will be described later, are connected by the second flow path F2.

The first pump P1 transports the cleaning liquid L from the main tank 62 to the sub tank 64 using the first flow path F1. In addition, the second pump P2 transfers the cleaning liquid L from the sub tank 64 to the cleaning unit 70 using the second flow path F2. Here, the second pump P2 continuously supplies the cleaning liquid L from the sub tank 64 to the cleaning tank 72 during a period in which the cleaning operation is performed.

[Cleaning Unit]

The cleaning unit 70 has a function of carrying out ultrasonic vibration of the cleaning liquid L that is supplied from the cleaning liquid supply unit 60. The cleaning unit 70 is configured to include the cleaning tank 72, a waste liquid receiving unit 74, and an ultrasonic wave generation device 76. Here the cleaning tank 72 is an example of a container.

[Cleaning Tank]

The cleaning tank 72 has a function of accommodating the cleaning liquid L that cleans the nozzle forming surface 32. The cleaning tank 72 is a cuboid-shaped container at the upper side of which an opening 72A is formed (see FIGS. 3 and 4). The cleaning tank 72 is configured to include a bottom plate 72B with a rectangular shape, and four side plates 72C. The entire periphery of the lower end of each side plate 72C is connected to the outer periphery of the bottom plate 72B. As shown in FIGS. 2 and 3, the cleaning tank 72 of the present embodiment is disposed in a state where the longitudinal direction thereof is along the longitudinal direction (apparatus depth direction) of the head 30. In addition, inside the cleaning tank 72, for example, a length L1 in the apparatus depth direction is 92.8 mm, a width L2 in the apparatus width direction is 68 mm, and a height H is 91.8 mm. Here, the upper end of each side plate 72C is the peripheral edge of the opening 72A. In addition, a through hole 72C1 is formed in each side plate 72C, and the end section of the second flow path F2 is connected to the through hole 72C1.

As described above, the head 30 is positioned in the apparatus height direction and is moved between the first position and the second position by being moved by the moving apparatus MA. In addition, the upper end (opening 72A) of the cleaning apparatus 40 is disposed further on the lower side in the apparatus height direction than the lower end (nozzle forming surface 32) of the head 30. For this reason, the cleaning tank 72 is separated from the nozzle forming surface 32 that moves between the first position and the second position. That is, for example, a 1 mm gap G is formed between (the opening 72A of) the cleaning tank 72 and the nozzle forming surface 32.

[Waste Liquid Receiving Unit and Waste Liquid Accommodation Unit]

The waste liquid receiving unit 74 receives and temporarily accommodates the cleaning liquid L (waste liquid) that includes foreign material that overflows from the gap G, and has a function of discharging the accommodated waste liquid to the waste liquid accommodation unit 80 (refer to FIG. 4). The waste liquid receiving unit 74 is configured to include a bottom plate 74A with a rectangular shape, four side plates 74B, and a third flow path F3. Each side plate 74B has a rectangular shape when viewed from the apparatus height direction. The four side plates 74B surround the four side plates 72C of the cleaning tank 72. The bottom plate 74A is connected to the underside of the bottom plate 72B of the cleaning tank 72 and the lower end of each side plate 74B. Here, through holes 74A1 and 74A2 are respectively formed in the bottom plate 74A where a portion overlaps with the bottom plate 72B and a portion does not overlap, and a through hole 74B1 is formed in the side plate 74B. Another end of the third flow path F3 in which an end is disposed inside the waste liquid accommodation unit 80 is connected to the through hole 74A2. The second flow path F2 is fitted in the through hole 74B1. For the configuration above, the waste liquid receiving unit 74 receives and temporarily accommodates the cleaning liquid L that overflows from the gap G, and the accommodated cleaning liquid L is discharged to the waste liquid accommodation unit 80. Here, the technical meaning of the through hole 74A1 being formed in the bottom plate 72B will be described later.

[Ultrasonic Wave Generation Device]

As shown in FIG. 4, the ultrasonic wave generation device 76 is configured to include an ultrasonic vibrator TR (hereinafter referred to as a "vibrator TR") and a power source PS.

Figure 5:
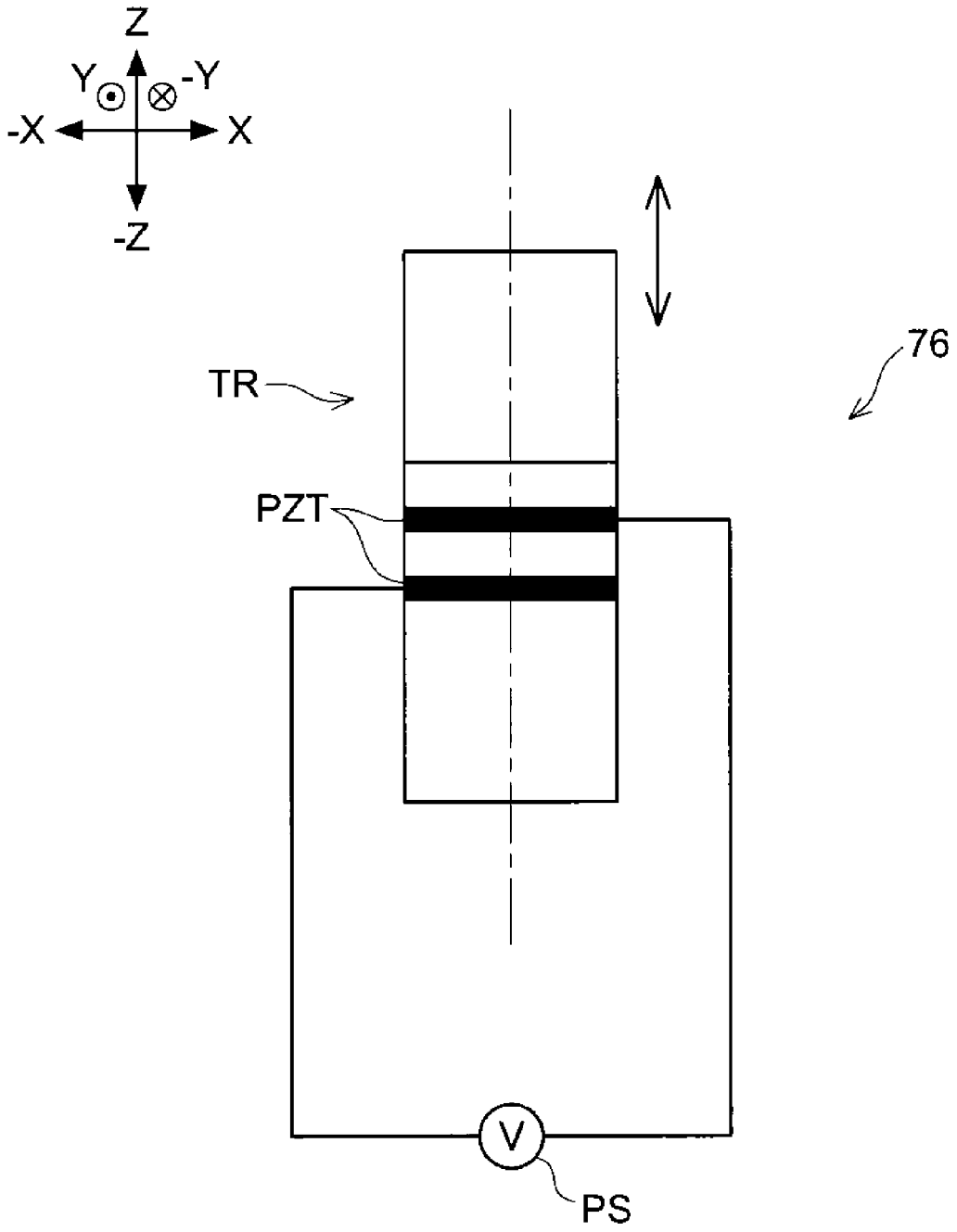
FIG. 5 is a schematic view of an ultrasonic vibrator that configures the cleaning apparatus according to the first embodiment.

The vibrator TR has a function of vibrating (ultrasonically vibrating) the cleaning liquid L that is accommodated in the cleaning tank 72. Here, the ultrasonic wave in the present specification is a sound wave at a frequency of vibration of 20 kHz or more. As shown in FIG. 5, the vibrator TR of the present embodiment is, for example, a bolt fitted Langevin-type vibrator. Here, the vibrator TR of the present embodiment is configured to be formed in a cylindrical shape, and, when alternating-current voltage is applied by the power source PS, to vibrate in an axial direction (arrow direction in the drawings) by a volume variation of a piezoelectric element PZT.

The diameter of the vibrator TR is smaller than the diameter of the through hole 74A1 of the waste liquid receiving unit 74 described above. Then, as shown in FIG. 4, the end section of the vibrator TR is fixed by adhering to the bottom plate 72B of the cleaning tank 72 that exposed by the through hole 74A1. That is, the vibrator TR is provided in the cleaning tank 72. In addition, the other end of the vibrator TR is fixed to a frame (not shown) inside the liquid droplet ejection apparatus 10. For the configuration above, when the alternating-current voltage is applied by the power source PS, the vibrator TR vibrates (ultrasonically vibrates) in the axial direction, and the cleaning liquid L that is accommodated in the cleaning tank 72 is vibrated by the vibration of the bottom plate 72B. Here, the vibrator TR of the present embodiment, for example, vibrates at a frequency at which a standing wave is not formed in the cleaning liquid L that is accommodated in the cleaning tank 72.

[Waste Liquid Accommodation Unit]

As described above, the waste liquid accommodation unit 80 has a function of accommodating the waste liquid that is discharged from the waste liquid receiving unit 74 of the cleaning unit 70. As shown in FIG. 4, the waste liquid accommodation unit 80 is a container that is disposed further on the lower side in the apparatus height direction than the waste liquid receiving unit 74.

[Relationship Between Elements Configuring Cleaning Apparatus]

The relationship between elements that configure the cleaning apparatus 40 that is described above will be described below.

As described above, during the cleaning operation, the cleaning tank 72 and the head 30 face each other, and have a relationship in which the gap G is formed between (the opening 72A of) the cleaning tank 72 and the nozzle forming surface 32. In addition, during the cleaning operation, the second pump P2 of the cleaning liquid supply unit 60 continuously supplies the cleaning liquid L from the sub tank 64 to the cleaning tank 72. For this reason, the cleaning liquid supply unit 60 supplies the cleaning liquid L to the cleaning tank 72 such that the cleaning liquid L overflows from the gap G (see FIG. 4).

In addition, the cleaning tank 72 and the cleaning liquid supply unit 60 cause the cleaning liquid L to come into contact with the nozzle forming surface 32 in a state where the opening 72A is caused to face the nozzle forming surface 32 by the cleaning liquid supply unit 60 supplying the cleaning liquid L in the cleaning tank 72 such that the cleaning liquid L overflows from the gap G. Here, a combination 90 of the cleaning tank 72 and the cleaning liquid supply unit 60 is an example of contact unit. Here, "face" in the present specification has the meaning of objects being separated and facing each other.

The configuration of the cleaning apparatus 40 of the present embodiment is described above.

<Cleaning Operation of Cleaning Apparatus>

Next, the cleaning operation of the cleaning apparatus 40 of the present embodiment will be described with reference to the drawings.

The control unit 50 causes the cleaning apparatus 40 to perform the cleaning operation when the value of the total amount of liquid droplets ejected by the head 30 that is stored in the memory device reaches a predetermined amount.

First, the control unit 50 drives the first pump P1 and the second pump P2 of the cleaning apparatus 40, and starts the supply of the cleaning liquid L to the cleaning tank 72. In addition, the control unit 50 applies an alternating-current voltage from the power source PS of the ultrasonic wave generation device 76 to the vibrator TR. As a result, the cleaning liquid L that is accommodated in the cleaning tank 72 vibrates (ultrasonically vibrates).

Next, the control unit 50 moves the head 30 disposed in the first position to the second position using the moving apparatus MA (see FIG. 2). For this reason, the nozzle forming surface 32 of the head 30 moves in the longitudinal direction of the head 30 while coming into contact with the cleaning liquid L which vibrates inside the opening 72A of the cleaning tank 72. As a result, the foreign material adhered to the nozzle forming surface 32 is removed by the cleaning apparatus 40. Here, the foreign material that is removed from the nozzle forming surface 32 overflows from the gap G with the cleaning liquid L, is temporarily accommodated in the waste liquid receiving unit 74, and then is accommodated in the waste liquid accommodation unit 80 using the third flow path F3.

When the head 30 is moved to the second position, the control unit 50 stops driving of the first pump P1 and the second pump P2 of the cleaning apparatus 40 and application of the alternating-current voltage from the power source PS of the ultrasonic wave generation device 76 to the vibrator TR, and moves the head 30 to the first position using the moving apparatus MA. Then, the control unit 50 ends the cleaning operation by resetting the value of the total amount of the liquid droplets ejected by the head 30 that is stored in the memory device.

The cleaning operation of the cleaning apparatus 40 of the present embodiment is described above.

Actions of First Embodiment

Next, the actions of the present embodiment will be described.

[First Action]

The first action is an action in which the foreign material adhered to the nozzle forming surface 32 of the head 30 is removed by ultrasonically vibrating the cleaning liquid L using the vibrator TR. The first action will be described below by comparing the first embodiment with a first comparative example described below and with reference to the drawings. Here, in a case where components and the like used in the first embodiment are used in the first comparative example, even if not illustrated, the reference numerals, designation, and the like of the components are used without change.

A liquid droplet ejection apparatus of the first comparative example (not shown) is provided with a rubber wiper (not shown) in place of the cleaning apparatus 40 of the first embodiment. Then, the liquid droplet ejection apparatus of the first comparative example removes the foreign material by wiping the nozzle forming surface 32 of the head 30 that moves from the first position to the second position using the rubber wiper. Aside from the above points, the liquid droplet ejection apparatus of the first comparative example is configured in the same manner as the liquid droplet ejection apparatus 10 of the first embodiment.

As described above, in the first comparative example, the nozzle forming surface 32 is wiped using the rubber wiper when the foreign material on the nozzle forming surface 32 is removed. For this reason, in the first comparative example, there is a risk that the nozzle forming surface 32 on which a water-repellent coat is formed deteriorates due to being rubbed by the rubber wiper. Then, in the first comparative example, there is a risk that ejection defects of the liquid droplets are occurred by the head 30 because ink is likely to be retained in a portion of an edge of the nozzle N on the nozzle forming surface 32 when the nozzle forming surface 32 deteriorates.

In contrast to this, in the first embodiment, the cleaning liquid L is removed by being ultrasonically vibrated using the vibrator TR that is provided in the cleaning tank 72 without removing the foreign material by wiping the nozzle forming surface 32 using the rubber wiper in the manner of the first comparative example (see FIG. 4). For this reason, in the first embodiment, unlike the first comparative example, the nozzle forming surface 32 is not rubbed.

Accordingly, according to the cleaning apparatus 40 of the first embodiment, deterioration is not easily occurred in the nozzle forming surface 32 in comparison to a case where the foreign material on the nozzle forming surface 32 is removed by wiping the nozzle forming surface 32. Accompanying this, according to the liquid droplet ejection apparatus 10 of the first embodiment, occurrence of ejection defects of the liquid droplets accompanying deterioration of the nozzle forming surface 32 is suppressed in comparison to the case where the foreign material on the nozzle forming surface 32 is removed by wiping the nozzle forming surface 32.

[Second Action]

The second action is an action in which the cleaning liquid L is supplied by the cleaning liquid supply unit 60 to the cleaning tank 72 such that the cleaning liquid L overflows from the gap G between the cleaning tank 72 and the nozzle forming surface 32. The second action will be described below by comparing the first embodiment to a second comparative example described below and with reference to the drawings. Here, in a case where components and the like that are used in the first embodiment are used in the second comparative example, even if not illustrated, the reference numerals, designation, and the like of the components are used without change.

A cleaning apparatus of the second comparative example (not shown) is not provided with the waste liquid receiving unit 74 and the waste liquid accommodation unit 80, being different from the cleaning apparatus 40 of the present embodiment. Aside from the above points, the cleaning apparatus of the second comparative example is configured in the same manner as the cleaning apparatus 40 of the present embodiment. In addition, a liquid droplet ejection apparatus of the second comparative example (not shown) is configured in the same manner as the liquid droplet ejection apparatus 10 of the present embodiment aside from being provided with the cleaning apparatus of the second comparative example in place of the cleaning apparatus 40 of the first embodiment.

In the second comparative example, the cleaning liquid L within the cleaning tank 72 does not overflow to the outside of the cleaning tank 72 during the cleaning operation. For this reason, the foreign material that is removed from the nozzle forming surface 32 by ultrasonic vibration of the cleaning liquid L does not overflow to the outside of the cleaning tank 72 with the cleaning liquid L. As a result, there is a risk that the foreign material that is removed once is reattached to the nozzle forming surface 32.

In contrast to this, in the first embodiment, the cleaning liquid L is supplied by the cleaning liquid supply unit 60 to the cleaning tank 72 such that the cleaning liquid L overflows from the gap G between the cleaning tank 72 and the nozzle forming surface 32 (see FIG. 4). For this reason, in the first embodiment, the foreign material that is removed from the nozzle forming surface 32 by ultrasonic vibration of the cleaning liquid L is likely to be ejected by overflowing to the outside of the cleaning tank 72 with the cleaning liquid L.

Accordingly, according to the cleaning apparatus 40 of the first embodiment, it is difficult for the foreign material that is removed from the nozzle forming surface 32 to be reattached to the nozzle forming surface 32 in comparison to a case in which the cleaning is performed without the cleaning liquid L being caused to overflow from the cleaning tank 72.

Second Embodiment

Next a second embodiment will be described. Here, in a case where components and the like that are used in the first embodiment are used in the second embodiment, even if not illustrated, the reference numerals, designation, and the like of the components are used without change.

Configuration of Second Embodiment

A cleaning apparatus 40A of the second embodiment will be described below with reference to FIG. 6.

In the cleaning apparatus 40A of the second embodiment, the vibrator TR is not fixed to the bottom plate 72B of the cleaning tank 72, and out of four side plates 72C, is fixed to the outer surface of the side plate 72C on the front side in the apparatus depth direction. That is, in the second embodiment, the vibrator TR is provided on the side plate 72C of the cleaning tank 72. Then, the vibrator TR of the second embodiment vibrates in the apparatus depth direction, in other words, the longitudinal direction of the head 30. In addition, as described above, a length L1 in the longitudinal direction of the head 30 inside the cleaning tank 72 is 92.8 mm, the frequency of the vibration of the vibrator TR is 28 kHz, and the speed of sound in the cleaning liquid L is approximately 1483 m/s. According to the conditions above, in the longitudinal direction of the head 30, in the cleaning liquid L inside the cleaning tank 72, the vibrator TR forms a standing wave in which a wavelength λ is, for example, set to 53 mm by setting the inner surface of the side plate 72C that faces the side plate 72C on which the vibrator TR is fixed as a fixing end. Here, the height of the cleaning tank 72 of the second embodiment is lower than the height of the cleaning tank 72 of the first embodiment.

Aside from the above points, the cleaning apparatus 40A of the second embodiment is configured in the same manner as the cleaning apparatus 40 of the first embodiment. In addition, a liquid droplet ejection apparatus 10A of the second embodiment is configured in the same manner as the liquid droplet ejection apparatus 10 of the first embodiment aside from being provided with the cleaning apparatus 40A of the second embodiment in place of the cleaning apparatus 40 of the first embodiment. Here, FIG. 6 illustrates by omitting components other than a portion of the vibrator TR and the cleaning tank 72 out of the cleaning apparatus 40A of the second embodiment.

Cleaning Operation of Second Embodiment

According to the configuration described above, the cleaning operation of the second embodiment is the same as the case of the first embodiment aside from the cleaning operation being performed in a state where the standing wave is formed along the longitudinal direction of the head 30 in the cleaning liquid L within the cleaning tank 72.

Actions if Second Embodiment

Next, the actions of the second embodiment will be described.

[First Action]

A first action is an action in which the vibrator TR is provided on the side plate 72C of the cleaning tank 72. The first action will be described below by comparing the second embodiment to a third comparative example that is described below and with reference to the drawings.

Figure 7:
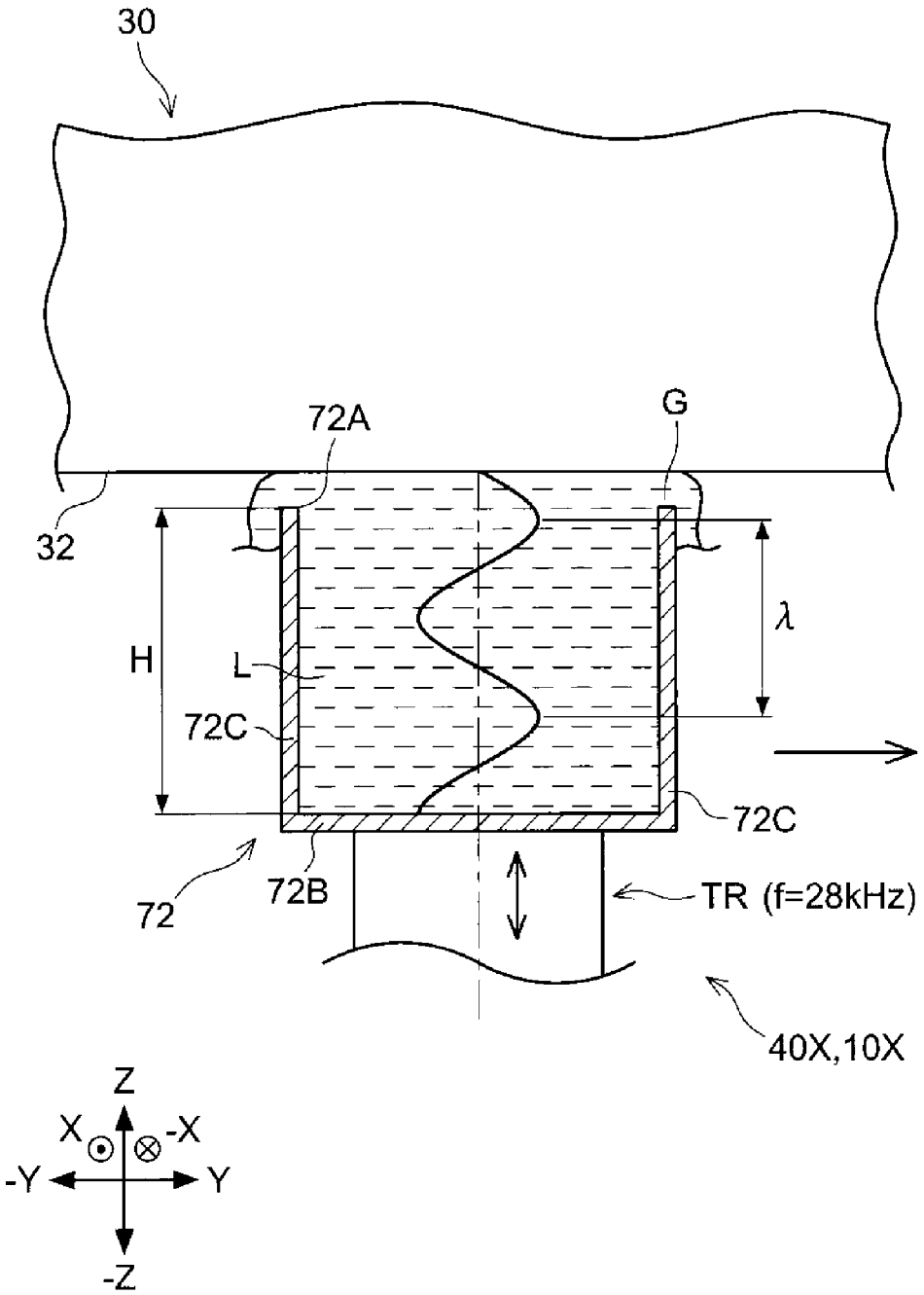
FIG. 7 is a schematic view of a portion of a head that configures a liquid droplet ejection apparatus and a portion of a cleaning apparatus according to a third comparative example.

A cleaning apparatus 40X (liquid droplet ejection apparatus 10X) of the third comparative example is configured in the same manner as the cleaning apparatus 40 (liquid droplet ejection apparatus 10) of the first embodiment (refer to FIG. 7). In the third comparative example, the vibrator TR is fixed to the bottom plate 72B of the cleaning tank 72 that faces the nozzle forming surface 32, the direction of the vibration of the cleaning liquid L that is vibrated by the vibrator TR is a perpendicular direction with respect to the nozzle forming surface 32. For this reason, whatever the frequency the vibration of the vibrator TR is set to, it is not possible for a portion of an antinode that is ultrasonically vibrated in the cleaning liquid L to come into contact with the nozzle forming surface 32. For example, when the frequency of the vibration of the vibrator TR of the third comparative example is set at 28 kHz, in the cleaning liquid L inside the cleaning tank 72, in the apparatus height direction, the vibrator TR of the third comparative example forms the standing wave in which a wavelength λ is, for example, set to 53 mm by setting the nozzle forming surface 32 as a fixing end (node). Here, a curve within the cleaning tank 72 in FIG. 7 indicates a waveform within the cleaning liquid L, a dashed line indicates a center line of the curve, a portion that overlaps with the dashed line on the curve indicates the node in the vibration, and a portion that is separated from the dashed line on the curve indicates the antinode in the vibration.

Figure 6:
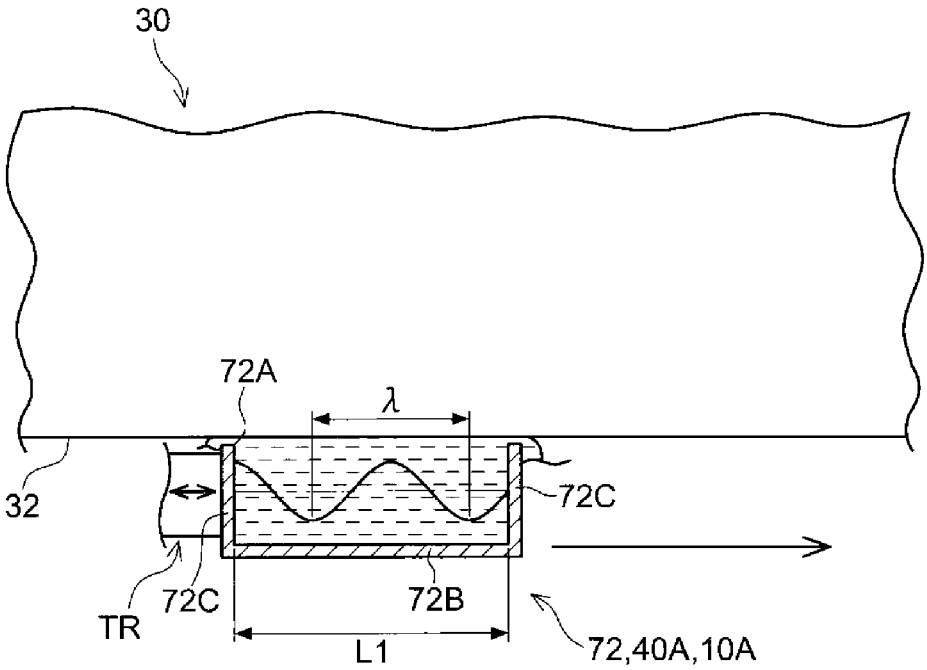
FIG. 6 is a schematic view of a portion of a head that configures a liquid droplet ejection apparatus and a portion of a cleaning apparatus according to a second embodiment.
Figure 6:
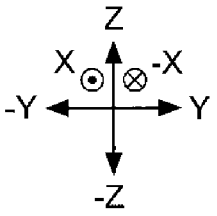

In contrast to this, as shown in FIG. 6, in the second embodiment, the vibrator TR is provided on a portion of the side plate 72C of the cleaning tank 72, and the vibration direction of the vibrator TR (vibration direction of the cleaning liquid L) is the longitudinal direction of the head 30 (apparatus depth direction).

Accordingly, according to the second embodiment, it is possible to cause the portion of the antinode of the ultrasonic vibration in the cleaning liquid L to come into contact with the nozzle forming surface 32. From another viewpoint, in the second embodiment, it is possible to largely remove the foreign material on the nozzle forming surface 32 in comparison to a case where the vibrator TR is provided on the bottom plate 72B of the cleaning tank 72, and the standing wave is formed in which the nozzle forming surface 32 is set as the fixing end in the cleaning liquid L by the vibrator TR.

[Second Action]

A second action is an action in which the standing wave is formed in the cleaning liquid L that is accommodated in the cleaning tank 72 by the vibrator TR vibrating in the longitudinal direction of the head 30, and the cleaning tank 72 is moved in the longitudinal direction of the head 30 relative to the head 30. The second action will be described below by comparing the second embodiment to a fourth comparative example described below and with reference to the drawings. Here, in a case where components and the like that are used in the second embodiment are used in the fourth comparative example, even if not illustrated, the reference numerals, designation, and the like of the components are used without change.

In the cleaning apparatus of the fourth comparative example (not shown), the cleaning tank 72 does not move in the longitudinal direction of the head 30 relative to the head 30 during the cleaning operation. In detail, the length in the longitudinal direction of the head 30 in the cleaning tank 72 of the fourth comparative example is set to be wider than a range in which all the nozzles N are formed. Then, in the fourth comparative example the control unit 50 moves the head 30 from the first position to the second position, then causes the cleaning apparatus to perform the cleaning operation in a state which encloses the range in which all of the nozzles N are formed within the opening 72A of the cleaning tank 72. In this case, the cleaning liquid L within the cleaning tank 72 forms the standing wave in a direction along the longitudinal direction of the head 30. Aside from the above points, the cleaning apparatus (liquid droplet ejection apparatus) of the fourth comparative example is the same as the cleaning apparatus 40 of the second embodiment. Aside from the above points, the cleaning operation of the fourth comparative example is configured in the same manner as the cleaning operation of the second embodiment.

In the fourth comparative example, the nozzle forming surface 32 mixedly has the portion that comes into contact with the antinode of the ultrasonic vibration in the cleaning liquid L and the portion which comes into contact with the node. As a result, in the fourth comparative example, there is a risk that cleaning maculation remains in the longitudinal direction of the head 30 on the nozzle forming surface 32.

In contrast to this, as shown in FIG. 6, in the second embodiment, the cleaning tank 72 moves in the longitudinal direction of the head 30 relative to the head 30 in a state where the standing wave is formed in the cleaning liquid L that is accommodated in the cleaning tank 72 by the vibrator TR vibrating in the longitudinal direction of the head 30. For this reason, in the second embodiment, it is possible to clean the nozzle forming surface 32 while moving the nozzle forming surface 32 in the longitudinal direction of the head 30 in the cleaning liquid L in which the portion of the antinode of the ultrasonic vibration and the portion of the node are alternately formed along the longitudinal direction of the head 30 within the cleaning tank 72.

Accordingly, according to the second embodiment, it is possible to reduce the cleaning maculation in the longitudinal direction of the head 30 on the nozzle forming surface 32 in comparison to a case where the standing wave is formed in the cleaning liquid L that is accommodated in the cleaning tank 72 by providing the vibrator TR on the side plate 72C, and the cleaning tank 72 does not move relative to the head 30.

Other actions of the second embodiment are the same as those of the first embodiment.

Third Embodiment

Next a third embodiment will be described.

Configuration of Third Embodiment

Figure 8:
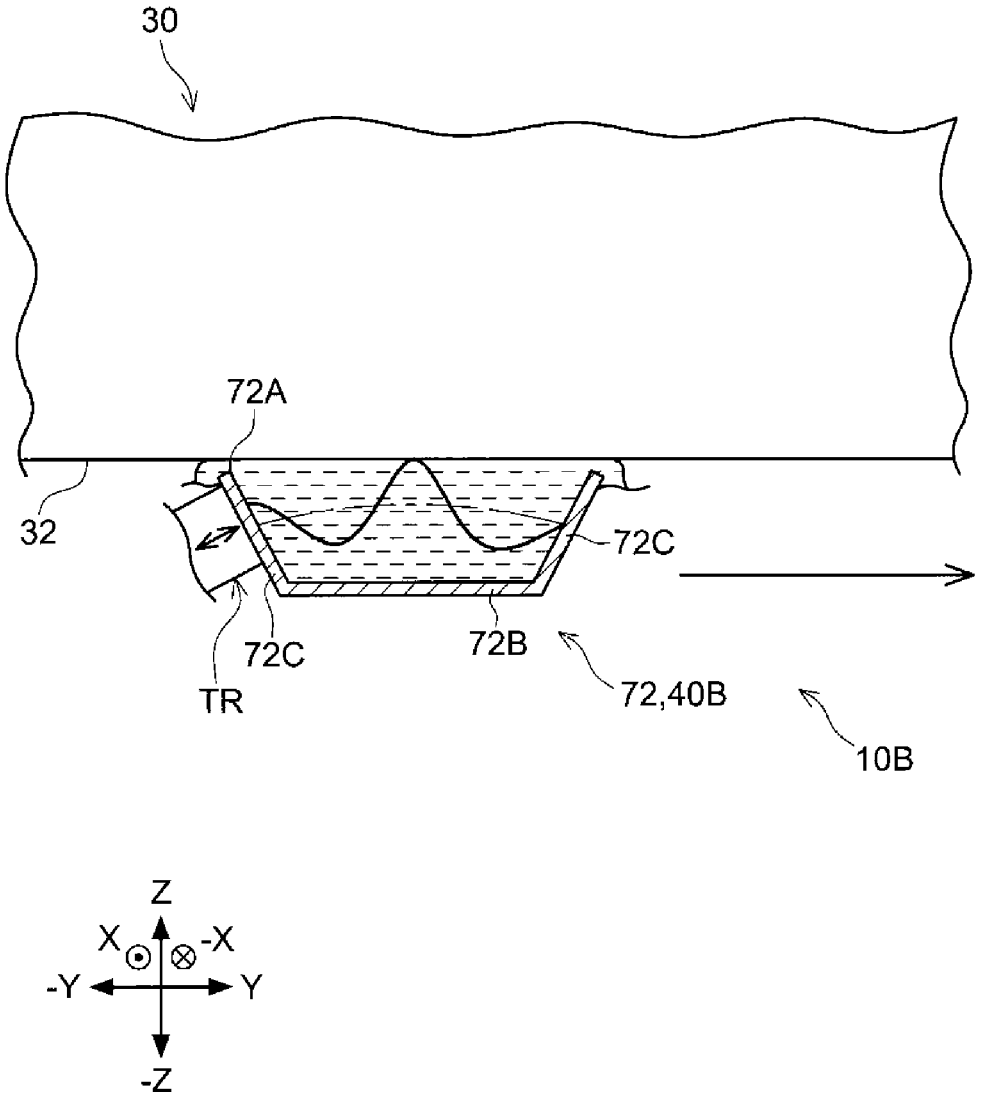
FIG. 8 is a schematic view of a portion of a head that configures a liquid droplet ejection apparatus and a portion of a cleaning apparatus according to a third embodiment.

A cleaning apparatus 40B of the third embodiment will be described below with reference to FIG. 8.

In the cleaning apparatus 40B of the third embodiment, the side plate 72C of the cleaning tank 72 is inclined with respect to the apparatus height direction such that the distance between facing surfaces of the side plates 72C gradually increases upwards in the apparatus height direction. In addition, in the third embodiment, the portion of the side plate 72C on which the vibrator TR is fixed and the portion of the side plate 72C that is the fixed end are oriented toward the nozzle forming surface 32. Aside from the above points, the cleaning apparatus 40B of the third embodiment is configured in the same manner as the cleaning apparatus 40A of the second embodiment. In addition, a liquid droplet ejection apparatus 10B of the third embodiment is configured in the same manner as the liquid droplet ejection apparatus 10A of the second embodiment aside from being provided with the cleaning apparatus 40B of the third embodiment in place of the cleaning apparatus 40A of the second embodiment.

Cleaning Operation of Third Embodiment

Aside from the cleaning operation being performed using the cleaning apparatus 40B, the cleaning operation of the third embodiment is the same as the case of the second embodiment.

Action of Third Embodiment

In the third embodiment, the portion of the side plate 72C on which the vibrator TR is fixed and the portion of the side plate 72C that is the fixed end are oriented toward the nozzle forming surface 32. For this reason, in the third embodiment, the direction of the vibration of the cleaning liquid L is oriented toward the nozzle forming surface 32 in comparison to a case where the side plate 72C is along the apparatus height direction.

Accordingly, according to the third embodiment, cleaning capacity of the nozzle forming surface 32 is high (there is little foreign material left for removal) in comparison to a case where the side plate 72C is along the apparatus height direction. Other actions of the third embodiment are the same as those of the first and second embodiments.

Fourth Embodiment

Next a fourth embodiment will be described.

Configuration of Fourth Embodiment

Figure 9A:
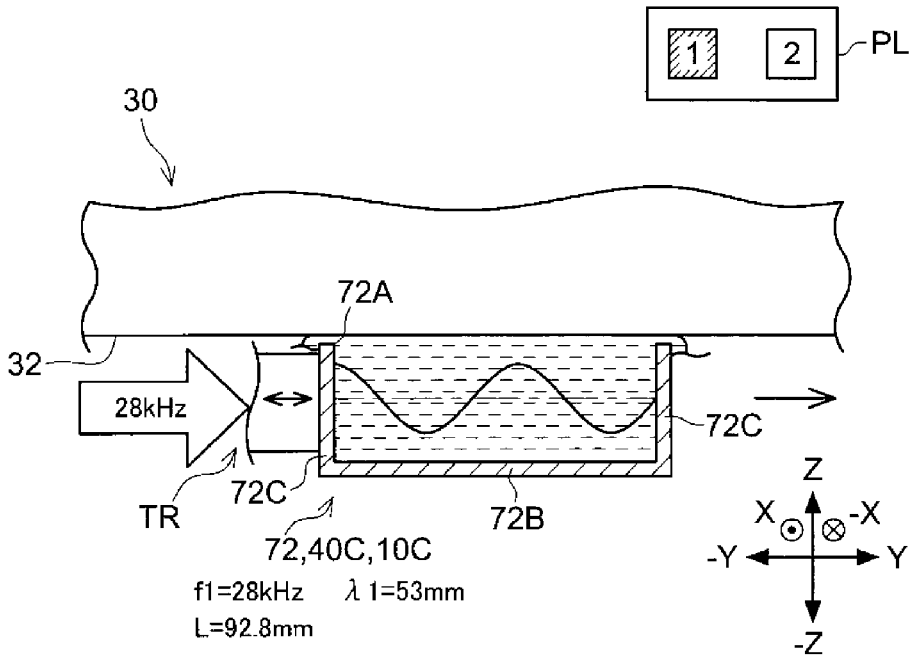
FIG. 9A is a schematic view of a portion of a head that configures a liquid droplet ejection apparatus and a portion of a cleaning apparatus according to a fourth embodiment in a case where the frequency of the vibration of an ultrasonic vibrator is 28 kHz.
Figure 9B:
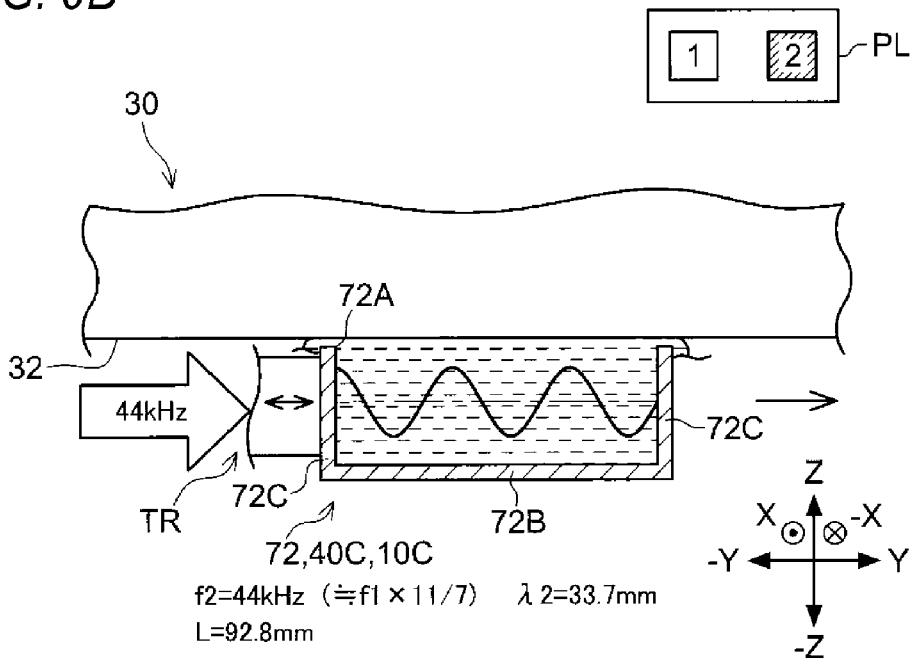
FIG. 9B is a schematic view of the portion of the head that configures the liquid droplet ejection apparatus and the portion of the cleaning apparatus according to the fourth embodiment in a case where the frequency of the vibration of the ultrasonic vibrator is 44 kHz.

A cleaning apparatus 40C of the fourth embodiment will be described below with reference to FIGS. 9A and 9B.

The cleaning apparatus 40C (liquid droplet ejection apparatus 10C) of the fourth embodiment is configured such that the power source PS of the ultrasonic wave generation device 76 vibrates the vibrator TR at plural frequencies. Here, the power source PS is an example of a vibration unit. In addition, in the fourth embodiment, a panel PL with which a user can select a frequency out of the plural frequencies is provided. Here, the panel PL is an example of selection unit. Here, for example, the panel PL of the fourth embodiment is provided on an exterior part (not shown) of the liquid droplet ejection apparatus 10C.

In detail, for example, the vibrator TR of the fourth embodiment is configured to vibrate at a frequency of either 28 kHz or 44 kHz. For example, the user selects and input the frequency at which to vibrate the vibrator TR, out of the plural frequencies, by pressing a button on the panel PL (either a button 1 or a button 2) according to the extent of uncleanliness of the nozzle forming surface 32. In the fourth embodiment, when the button 1 of the panel PL is pressed, the vibrator TR is vibrated at the frequency of 28 kHz, and when the button 2 is pressed, the vibrator TR is vibrated at the frequency of 44 kHz. Here, FIG. 9A illustrates a case where the cleaning operation is performed by the cleaning apparatus 40C vibrating the vibrator TR at the frequency of 28 kHz as a result of the user pressing the button 1 on the panel PL. In addition, FIG. 9B illustrates a case where the cleaning operation is performed by the cleaning apparatus 40C vibrating the vibrator TR at the frequency of 44 kHz as a result of the user pressing the button 2 on the panel PL. Aside from the above points, the cleaning apparatus 40C of the fourth embodiment is configured in the same manner as the cleaning apparatus 40 of the first embodiment. In addition, a liquid droplet ejection apparatus 10C of the fourth embodiment is configured in the same manner as the liquid droplet ejection apparatus 10 of the first embodiment aside from being provided with the cleaning apparatus 40C of the fourth embodiment in place of the cleaning apparatus 40 of the first embodiment.

Cleaning Operation of Fourth Embodiment

The cleaning operation of the fourth embodiment is the same as of the first embodiment aside from performing the cleaning operation using the cleaning apparatus 40C, that is, vibrating the vibrator TR by the user selecting the frequency at which to vibrate the vibrator TR out of the plural frequencies.

Action of Fourth Embodiment

According to the cleaning apparatus 40C of the fourth embodiment, it is possible to vibrate the cleaning liquid L that is accommodated in the cleaning tank 72 at plural frequencies.

Here, the lower the frequency at which the vibrator TR is vibrated, the more it is possible to remove the foreign material on the nozzle forming surface 32. In contrast to this, the higher the frequency at which the vibrator TR is vibrated, the more difficult it is to damage the nozzle forming surface 32. From this point, for example, it is also possible for the user to cause the cleaning apparatus 40C to perform the cleaning operation of the nozzle forming surface 32 by pressing the button 1 in a case where the foreign material on the nozzle forming surface 32 is great (a case in which uncleanliness is severe), and by pressing the button 2 in a case where the foreign material on the nozzle forming surface 32 is slight.

Figure 10A:
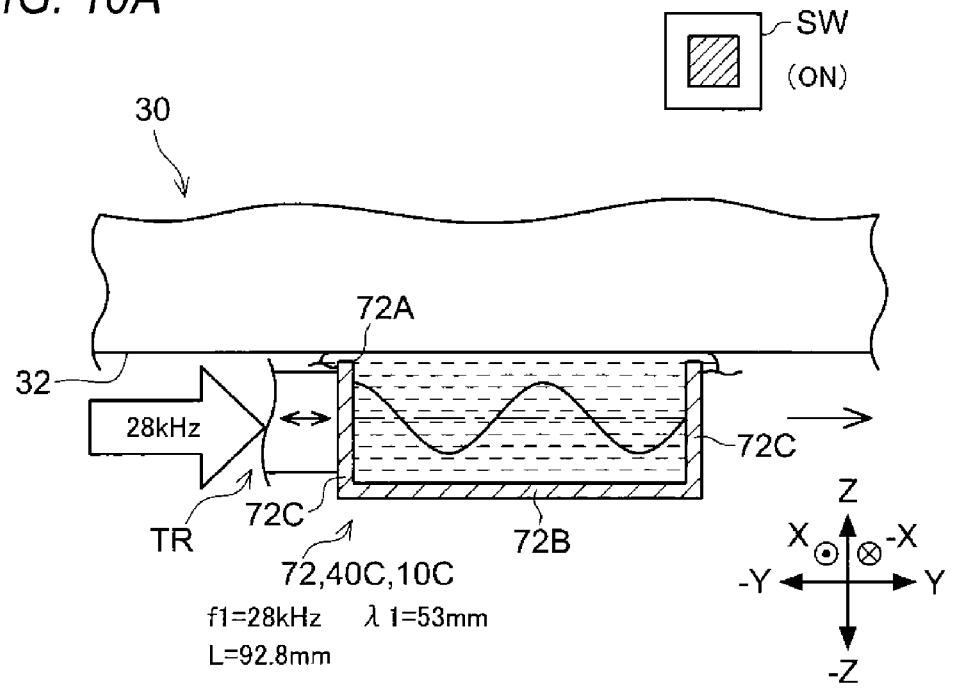
FIG. 10A is a schematic view of a portion of a head that configures a liquid droplet ejection apparatus and a portion of a cleaning apparatus of a modification example according to the fourth embodiment in a case where the frequency of the vibration of an ultrasonic vibrator is 28 kHz.
Figure 10B:
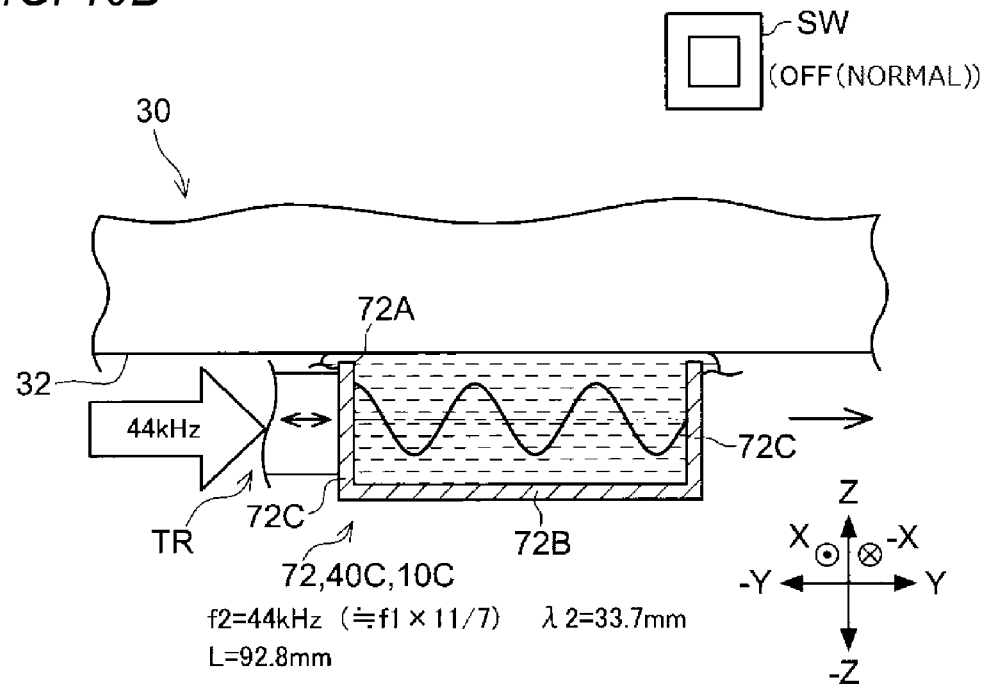
FIG. 10B is a schematic view of the portion of the head that configures the liquid droplet ejection apparatus and the portion of the cleaning apparatus of the modification example according to the fourth embodiment in a case where the frequency of the vibration of the ultrasonic vibrator is 44 kHz.

In addition, as shown in FIGS. 10A and 10B, as a modification example of the fourth embodiment, a selection switch SW may be provided in place of the panel PL, in the normal cleaning operation, vibration of the vibrator TR may be performed at a high frequency in the cleaning apparatus 40C, and when the switch SW is pressed (selected), the cleaning apparatus 40C may be caused to perform vibration of the vibrator TR at a low frequency. Here, the switch SW is an example of selection unit. For example, in a case where foreign material is great on the nozzle forming surface 32 (a case in which uncleanliness is severe), if the user presses the selection switch SW (refer to FIG. 10A), the cleaning apparatus 40C more easily removes the foreign material on the nozzle forming surface 32 than in the normal cleaning operation.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art.

For example, in each of the embodiments, the vibrator TR is described as being fixed to the outer surface of the bottom plate 72B or the side plate 72C of the cleaning tank 72. However, as long as the portion to which the vibrator TR is fixed is e vibrator TR may be fixed to the inner surface of the bottom plate 72B or the side plate 72C.

In addition, in the first embodiment, the vibrator TR is described as vibrating the cleaning tank 72 by being fixed to the bottom plate 72B of the cleaning tank 72. However, the through hole 74A1 need not be formed in the waste liquid receiving unit 74, the outer surface of the bottom plate 72B of the cleaning tank 72 may be fixed to the inner surface of the bottom plate 74A of the waste liquid receiving unit 74, and the cleaning tank 72 may be vibrated due to the vibrator TR being fixed to the outer surface of the bottom plate 74A. In this case, a portion that is interposed by the vibrator TR on the bottom plate 74A and the bottom plate 72B of the cleaning tank 72 is configured as a portion of the vibrator TR.

In addition, in the second to fourth embodiments, the cleaning liquid L within the cleaning tank 72 is described as being vibrated by the vibrator TR to form the standing wave. However, as long as the cleaning liquid L within the cleaning tank 72 is ultrasonically vibrated by the vibrator TR, the frequency of the vibration of the vibrator TR need not be the frequencies in the embodiments.

In addition, in the second to fourth embodiments, the vibrator TR is described as being fixed to the outer surface of the side plate 72C on the front side in the apparatus depth direction in the four side plates 72C of the cleaning tank 72. However, a portion to which the vibrator TR is fixed may be any portion out of the four side plates 72C.

In addition, the vibrator TR in each embodiment is described as a so-called bolt fitted Langevin-type vibrator. However, as long as it is possible for the cleaning liquid L within the cleaning tank 72 to be vibrated, a vibrator with a different form may be used. For example, a nickel vibrator, a ferrite vibrator, or other magnetostrictive vibrator may be used.

In addition, in each embodiment, the cleaning apparatus 40 and the head 30 are described as having a relationship of being relatively moved due to the cleaning apparatus 40 or the like being fixed inside the liquid droplet ejection apparatus 10 and the head 30 being moved from the first position to the second position. However, as long as the cleaning apparatus 40 and the head 30 have a relationship of being relatively moved, the head 30 may be fixed inside the liquid droplet ejection apparatus 10 and the cleaning apparatus 40 may move in the longitudinal direction of the head 30. In addition, the cleaning apparatus 40 and the head 30 may move together.

In addition, in each embodiment, the cleaning liquid L is described as being water. However, as long as it is possible to remove foreign material that is attached to the nozzle forming surface 32 by vibrating using an ultrasonic wave, the cleaning liquid L need not be water. For example, ethanol, paraffin based solvent, and other liquids may be used.

In addition, the cleaning apparatus 40 and the like in each embodiment are described as performing the cleaning operation while the cleaning liquid L overflows from the gap G between the cleaning tank 72 and the nozzle forming surface 32 of the head 30. However, the cleaning operation may be performed without the cleaning liquid L overflowing from the gap G during the cleaning operation. In this case, after the cleaning operation ends, the cleaning liquid L and the foreign material may be caused to overflow from the cleaning tank 72 by supplying the cleaning liquid L from the cleaning liquid supply unit 60 to the cleaning tank 72, and the cleaning liquid L and the foreign material may be recovered as waste liquid in the waste liquid accommodation unit 80.

In addition, in each embodiment, each aspect of the present invention is exemplified separately, but a form in which the elements of each embodiment are combined is included within the technical scope of the present invention. For example, the vibrator TR of the cleaning apparatus 40 of the first embodiment may be the vibrator TR of the fourth embodiment (a form in which vibration of plural frequencies is able to be generated).

The foregoing embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning apparatus comprising:

a contact unit that includes a container in which an opening is formed, the container including a bottom plate and at least one side plate, one end of the at least one side plate being connected to the bottom plate, and the container accommodating cleaning liquid that cleans a forming surface of an ejection unit, the forming surface on which an ejection opening is formed, the ejection opening from which a liquid droplet is ejected; and an ultrasonic vibrator that is provided at one of the at least one side plate of the container and vibrates the cleaning liquid accommodated in the container;

wherein the contact unit brings the cleaning liquid into contact with the forming surface in a state where the opening of the container faces the forming surface.

2. The cleaning apparatus according to claim 1, wherein the at least one side plate comprises a plurality of side plates, and the side plate at which the ultrasonic vibrator is provided is inclined with respect to a direction in which the opening of the container faces the forming surface such that a distance between the side plate at which the ultrasonic vibrator is provided and a side plate that faces the side plate at which the ultrasonic vibrator is provided gradually increases upwards in the direction in which the opening of the container faces the forming surface.

3. The cleaning apparatus according to claim 2, wherein the side plate that faces the side plate at which the ultrasonic vibrator is provided is inclined with respect to the direction in which the opening of the container faces the forming surface such that facing surfaces of the side plate at which the ultrasonic vibrator is provided and the side plate that faces the side plate at which the ultrasonic vibrator is provided are oriented toward the forming surface.

4. The cleaning apparatus according to claim 1, wherein the ejection unit has an elongated shape, the ultrasonic vibrator vibrates in a longitudinal direction of the ejection unit to generate a standing wave in the cleaning liquid accommodated in the container, and the cleaning apparatus further comprises a moving unit that moves the container relative to the ejection unit in the longitudinal direction.

5. The cleaning apparatus according to claim 1, wherein the contact unit includes a supply unit that supplies the cleaning liquid to the container such that the cleaning liquid overflows from a gap between the container and the forming surface.

6. The cleaning apparatus according to claim 1, further comprising:

a vibration unit that vibrates the ultrasonic vibrator at a plurality of frequencies; and a selecting unit with which a selection instruction of a frequency at which the vibration unit vibrates the ultrasonic vibrator out of the plurality of frequencies is input.

7. A liquid droplet ejection apparatus comprising:

an ejection unit that ejects a liquid droplet from an ejection opening, the ejection opening is formed on a forming surface of the ejection unit; and the cleaning apparatus according to claim 1 that cleans the forming surface.

* * * * *